US005670762A

United States Patent [19]

Futamura

[11] Patent Number: 5,670,762

[45] Date of Patent: Sep. 23, 1997

[54] PUSH LOCK SWITCH WITH DUAL FUNCTION SELF-BIASING SLIDER CONTACT

[75] Inventor: Tatsuya Futamura, Aichi-ken, Japan

[73] Assignee: Kabushiki Kaisha Tokai Rika Denki Seisakusho, Aichi-ken, Japan

[21] Appl. No.: 579,146

[22] Filed: Dec. 27, 1995

[30] Foreign Application Priority Data

Jan. 6, 1995 [JP] Japan ..... 7-000873

[51] Int. Cl.[6] ..... H01H 13/56; H01H 15/02

[52] U.S. Cl. ..... 200/16 D; 200/524

[58] Field of Search ..... 200/5 R, 5 B, 200/5 C, 5 E, 16 R, 16 A, 16 B, 16 C, 16 D, 16 E, 16 F, 523, 524, 525, 532, 533, 534, 530, 531

[56] References Cited

U.S. PATENT DOCUMENTS

| | | | |
|---|---|---|---|
| B 376,504 | 1/1975 | Lockard | 200/524 |
| 3,697,713 | 10/1972 | Ohkita | 200/524 |
| 3,732,386 | 5/1973 | Ohkita | 200/524 |
| 4,382,167 | 5/1983 | Maruyama et al. | 200/16 F X |
| 4,531,026 | 7/1985 | Terajima et al. | 200/16 B X |
| 4,670,629 | 6/1987 | Vanbenthuysen et al. | 200/5 C |
| 5,539,169 | 7/1996 | Sekita | 200/524 |

*Primary Examiner*—J. R. Scott

*Attorney, Agent, or Firm*—Nikaido, Marmelstein, Murray & Oram LLP

[57] ABSTRACT

A push lock switch includes a switch body having walls and a plurality of the terminals each of which has a fixed contact. The switch body has a cam groove formed on one of the walls. A part of wall defining the cam groove serves as a hooking recess. The switch body has a lock pin and a slider movable between a projecting position and a retracted position. An end of the lock pin is inserted in the cam groove. The slider is held at the retracted position by engaging the end of the lock pin to the hooking recess. The switch body also has a leaf spring mounted on the slider. The leaf spring has a pressing portion to press the end of the lock pin against the bottom of the cam groove, and movable contacts for contacting to and being separated from the associated fixed contacts of the terminals in accordance with the movement of the slider. The fixed contacts are electrically connected to one another via the movable contacts touching the fixed contacts.

10 Claims, 6 Drawing Sheets

PUSH LOCK SWITCH WITH DUAL FUNCTION SELF-BIASING SLIDER CONTACT

BACKGROUND OF THE INVENTION

1. Field of the Invention

The present invention relates generally to a switching apparatus, and more particularly to a push lock switch.

2. Description of the Related Art

FIG. 5 illustrates a vertical cross section of a conventional push lock switch 51. A knob holder 54 is held retractably in a casing 52 of the push lock switch 51. A knob 53 is attached to the distal end of the knob holder 54. The knob holder 54 is urged or biassed by a coil spring 55 in the direction of its projection (i.e., toward the left side of FIG. 5). The casing 52 has a plurality of terminals 56 provided therein. The push lock switch 51 is connected to an electronic apparatus (not shown) via the terminals 56. Each of the terminals 56 has a proximal end serving as a fixed contact 57.

A leaf spring 59, having a plurality of movable contacts 58 (only one shown) formed at its distal end, is implanted in the knob holder 54 in the vicinity of the opposite end of the knob 53. The movable contacts 58 are pressed against an inner upper surface 52*a* of the casing 52 by the action of the leaf spring 59. Pushing the knob 53 in the direction A in FIG. 5 allows the fixed contacts 57 to be connected to each other via the movable contacts 58 of the leaf spring 59.

A lock pin holder 60 for a lock pin 61 is fitted in the upper wall of the casing 52. As shown in FIG. 6, the lock pin holder 60 has a hole 60*a* formed therethrough. A first end of the lock pin 61 is inserted in the hole 60*a* so that the lock pin 61 is held rotatably around the first end. As shown in FIG. 5, a cam groove 62 is formed on an upper wall 54*a* of the knob holder 54. A second end of the lock pin 61 is inserted in the cam groove 62. A substantially U-shaped lock pin spring 63 presses the lock pin 61 against the bottom of the cam groove 62.

As shown in FIGS. 7 and 8, a protuberance 62*a* is formed, on the upper wall 54*a* of the knob holder 54, to have a heart-shaped cross section and surrounded by the cam groove 62. The recessed side part of the protuberance 62*a* is used as a hooking recess 64. In the cam groove 62, four steps 71, 72, 73 and 74 are formed to surround the protuberance 62*a*. When the knob 53 is pressed in the direction A against the resiliency of the coil spring 55, the second end of the lock pin 61 is guided by the steps 71 and 72 and moves from the starting point to the hooking recess 64 along a path 75 indicated by a broken line in FIG. 7 so as to be engaged with the hooking recess 64. As a result, the knob holder 54, together with the knob 53, is locked and the fixed contacts 57 are connected to one another through the movable contacts Another press of the knob 53 in the direction A disengages the lock pin 61 from the hooking recess 64. Then the lock pin 61 returns to the starting point, while being guided by the steps 73 and 74, along a path 76 indicated by an alternate long and short dash line 76 in FIG. 7. The knob holder 54, together with the knob 53, is projected in the direction opposite to the direction A by the coil spring 55. Then, the movable contacts 58 are detached from the fixed contacts 57 so that the fixed contacts 57 are electrically disconnected from one another.

The conventional push lock switch 51 needs to have the lock pin spring 63 in order to press the lock pin 61 against the bottom of the cam groove 62. This increases the number of parts of the push lock switch 51. Also, the lock pin holder 60 needs to be attached to the casing 52 after the lock pin 61 is attached to the lock pin holder 60 by the lock pin spring 63. This increases the number of steps required to assemble the push lock switch 51, resulting in an increase of the manufacturing cost.

SUMMARY OF THE INVENTION

The present invention relates to a push lock switch made with the reduced number of parts or elements.

A push lock switch according to one embodiment of the invention includes a switch body including at least one wall and a plurality of the terminals each of which has a fixed contact. The switch body has a cam groove formed on the wall. A part of the wall defining the cam groove is used as a hooking recess. The switch body has a lock pin and a slider movable between a retracted position and a projecting position. The lock pin has an end to be inserted in the cam groove. The slider is held at the retracted position being engaged between the end of the lock pin and the hooking recess. The switch body also has a resilient member attached on the slider. The resilient member has a pressing portion to press the end of the lock pin against the bottom of the cam groove, and also has at least one movable contact which contacts to and separates from the individual fixed contacts of the terminals in accordance with the movement of the slider. The fixed contacts are electrically connected to one another via the movable contact touching the fixed contacts.

Other aspects and advantages of the invention will become apparent from the following detailed description, taken in conjunction with the accompanying drawings, illustrating by way of example the principals of the invention.

BRIEF DESCRIPTION OF THE DRAWINGS

The invention, together objects and advantages thereof, may best be understood by reference to the following description of the presently preferred embodiments together with the accompanying drawing in which.

DETAILED DESCRIPTION OF THE PREFERRED EMBODIMENT

Figure 1:
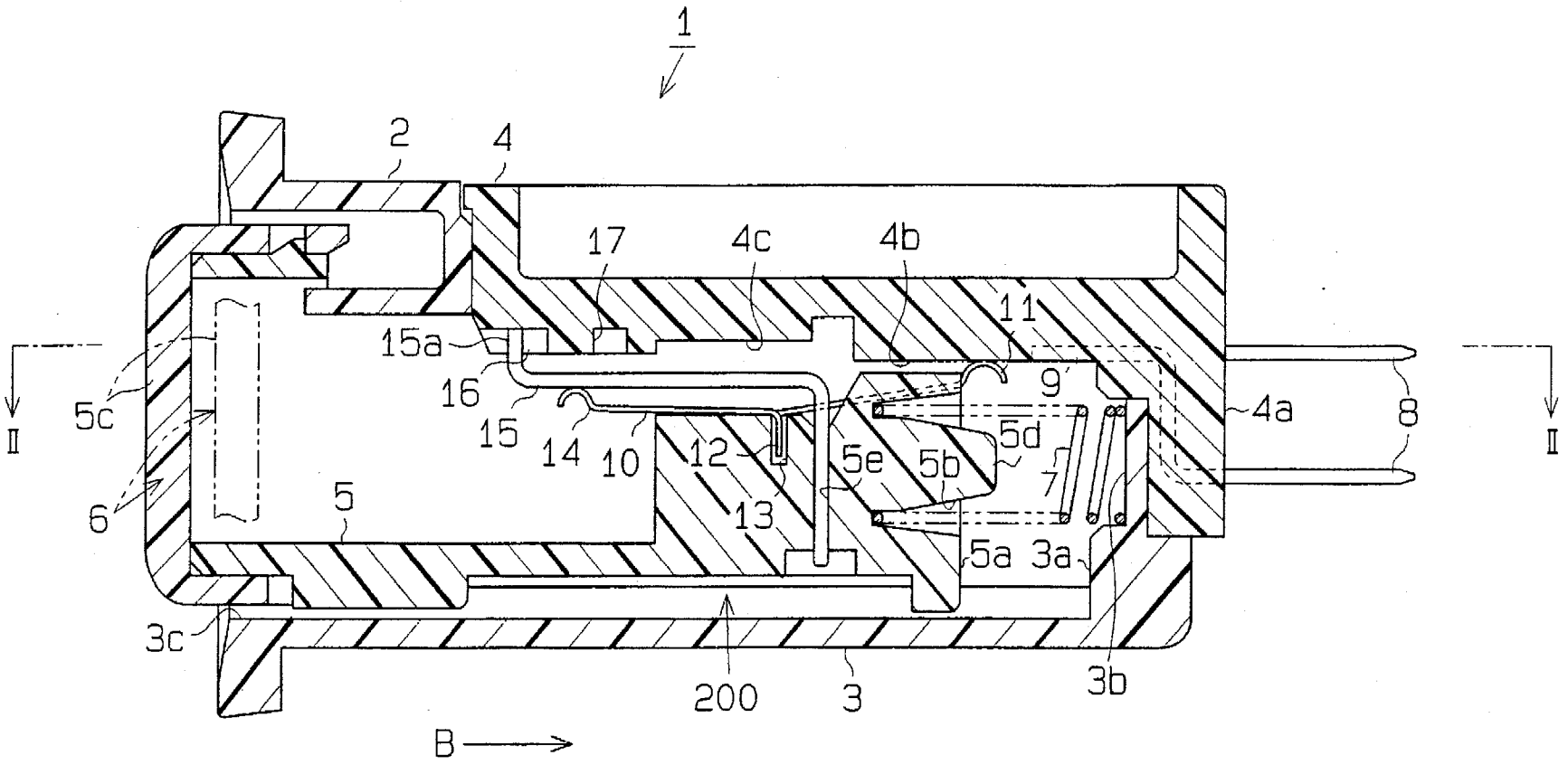
FIG. 1 is a vertical cross section of a push lock switch according to/an embodiment of the present invention.

A push lock switch according to the present invention will now be described referring to FIGS. 1 to 4. As shown in FIG. 1, a switch body 2 of a push lock switch 1 has a casing 3 and a cover 4. The casing 3 is formed to have substantially a rectangular parallelepiped shape and to have a chamber 200 therein. The casing 3 has an end (the left end in FIGS. 1 and 2) where an opening 3*c* is formed, and the other end which opens is sealed by the cover 4. Therefore, the chamber 200 opens at two places, that is, at the opening 3*c* and at the opening to be sealed by the cover 4. The cover 4 is made of an electrical insulating material. A knob holder 5 is movably retained in the chamber 200 of the casing 3 so that the head of the knob holder 5 can protrude out of the opening 3*c* and be retracted into the chamber 200. A knob 5*c* is attached to the head of the knob holder 5. The knob holder 5 and the knob 5*c* constitute a slider 6 which is movable between a projecting position and a retracted position. With the slider 6 at the projecting position, the knob 5*c* is located at the position expressed by the solid line in FIG. 1, while with the slider 6 at the retracted position, the knob 5*c* is located at the position expressed by the two-dotted chain line in FIG. 1.

A protuberance 5*d*, which is circular in cross section, is formed on an end wall 5*a* of the slider 6 at the opposite end of the knob 5*c*. Further, a ring-shaped recess 5*b* is formed on the end wall 5*a* to surround the protuberance 5*d*. The end wall 5*a* faces an inner wall 3*a* of the chamber 200 of the casing 3. A recess 3*b* is formed on the inner wall 3*a*. A coil spring 7 is placed between the recesses 3*b* and 5*b*. The coil spring 7 has an end fitted in the recess 5*b* and the other end applied to the recess 3*b*. The coil spring 7 exerts its resilient force on the slider 6 to project the knob 5*c* from the opening 3*a*.

Figure 2:
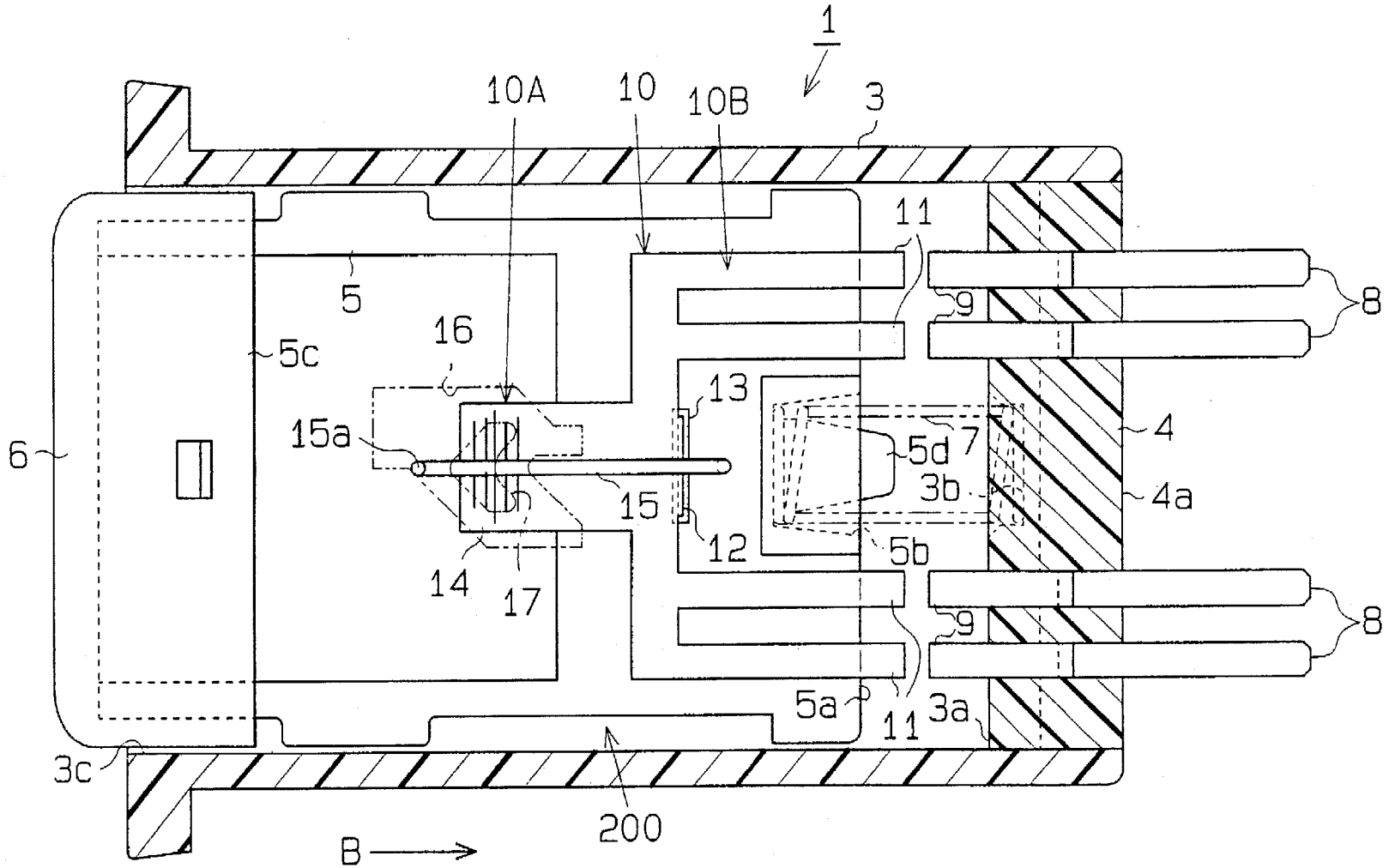
FIG. 2 is a horizontal cross section of the push lock switch taken along line II—II of FIG. 1.

A plurality of terminals 8 are attached to the cover 4 to be projected from the outer surface 4*a* of the cover 4. As shown in FIG. 2, the terminals 8 are placed side-by-side penetrating the cover 4. Each of the ends of the terminals 8 appearing on the inner wall of the cover 4 serves as a fixed contact 9, while the other ends projecting from the outer surface 4*a* are connected to an electronic apparatus (not shown).

As shown in FIGS. 1 and 2, a rectangular recess 13, extending in the width direction of the push lock switch 1, is formed on the top surface of the knob holder 5. The push lock switch 1 is provided with a leaf spring 10, which may be referred to as a resilient member, that is made of a conductive material. As shown in FIG. 2, the leaf spring 10 has a first section (left end) 10A, on which a curved pressing portion 14 as pressing means is formed, and a second section (right end) 10B as a comb-like section having a plurality of tips facing the fixed contacts 9. Each of the tips of the comb-like section 10B is curved to have a function as a movable contact (movable contacting means) 11. The number of the tips of the comb-like section 10B is equal to the number of the fixed contacts 9.

As shown in FIGS. 1 and 2, the leaf spring 10 further has a central portion 12 serving as an implant part. The implant part 12 is vertically extended downward. The width of the implant part 12 is equal to the width of the recess 13. The leaf spring 10 is fixed to the knob holder 5 by inserting the implant part 12 in the recess 13. This allows the leaf spring 10 to move with the movement of the knob holder 5. The resiliency of the comb-like section 10B causes the movable contacts 11 to be pressed against a first bottom surface 4*b* of the cover 4. Pressing the slider 6 in the direction B against the resiliency of the coil spring 7 causes the movable contacts 11 to come into contact with the fixed contacts 9. As a result, the fixed contacts 9 are electrically connected to one another via the movable contacts 11 which are in contact with the fixed contacts 9.

As shown in FIG. 1, a vertically extending hole 5*e* is formed at the right side of the recess 13 in the knob holder 5. A lock pin 15 is L-shaped. A lower end of the lock pin 15 is inserted in the hole 5*e* so that the lock pin 15 is rotatably supported around the hole 5*e*. The lock pin 15 has an upper end 15*a* that is bent vertically upward.

Figure 3:
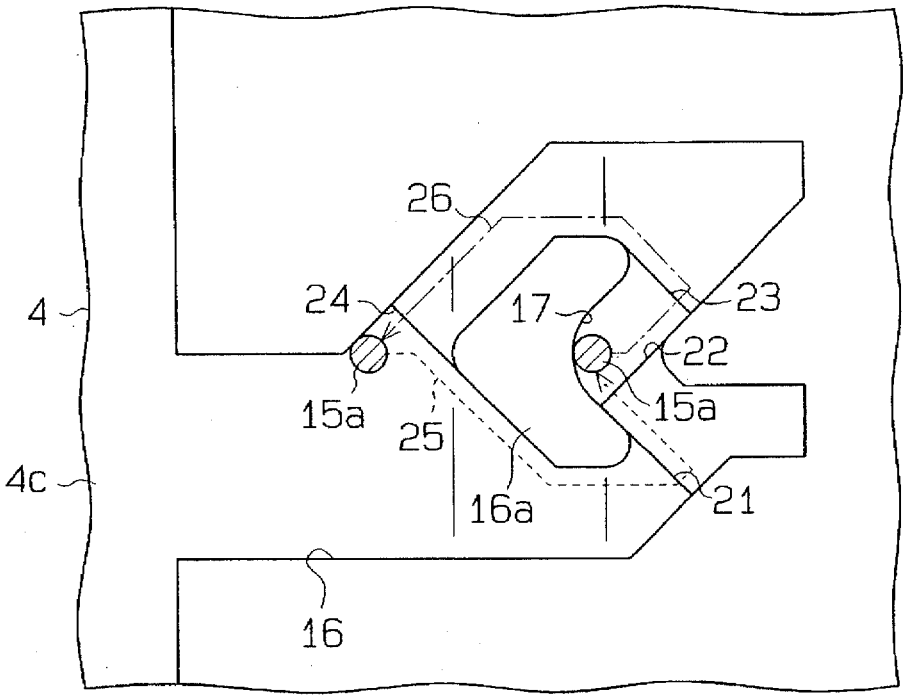
FIG. 3 is a plan view showing a cam groove of the push lock switch shown in FIG. 1.
Figure 4:
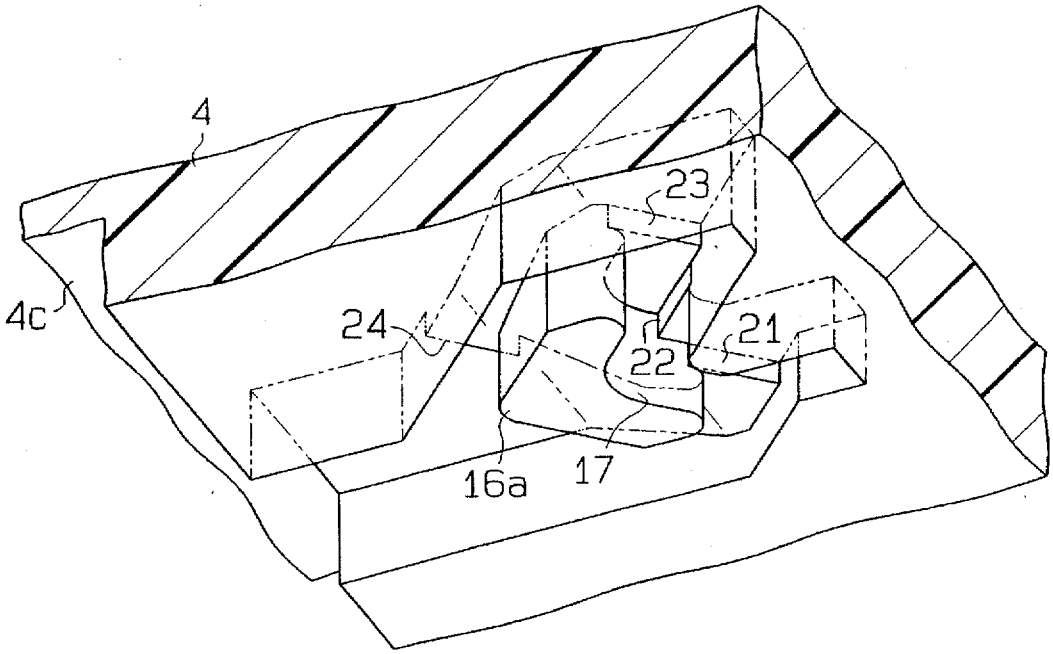
FIG. 4 is a perspective view illustrating the bottom of the cam groove shown in FIG. 3.
Figure 5:
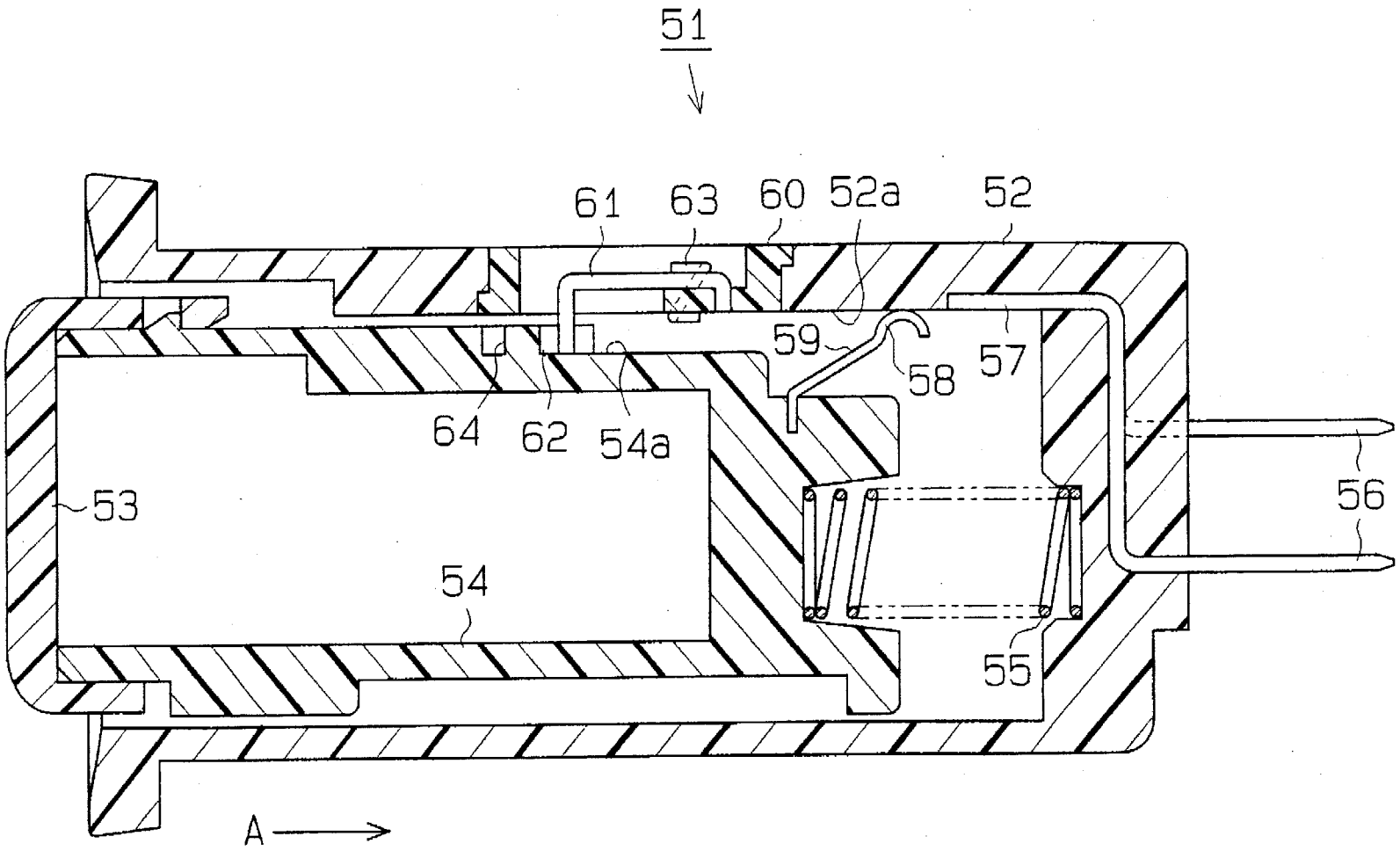
Fig.5 (Prior Art)
FIG. 5 is a vertical cross section of a conventional push lock switch.
Figure 6:
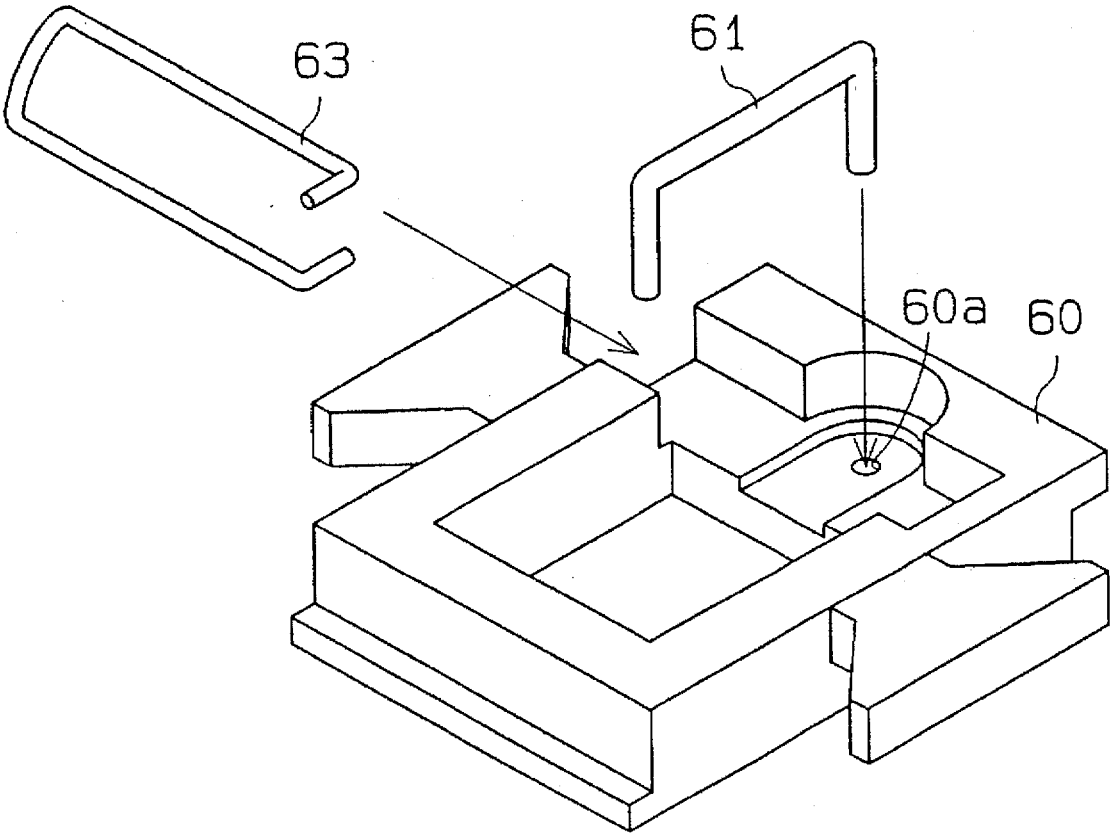
Fig.6 (Prior Art)
FIG. 6 is a perspective view illustrating a lock pin and a holder used in the conventional push lock switch shown in FIG. 5.
Figure 7:
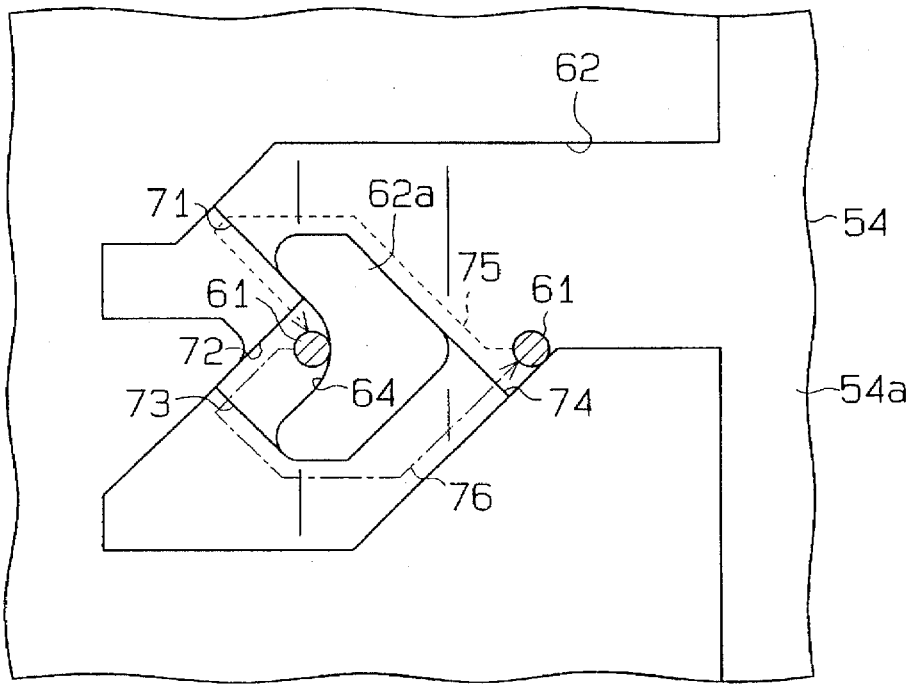
Fig.7 (Prior Art)
FIG. 7 is a plan view showing a cam groove of the conventional push lock switch shown in FIG. 5.
Figure 8:
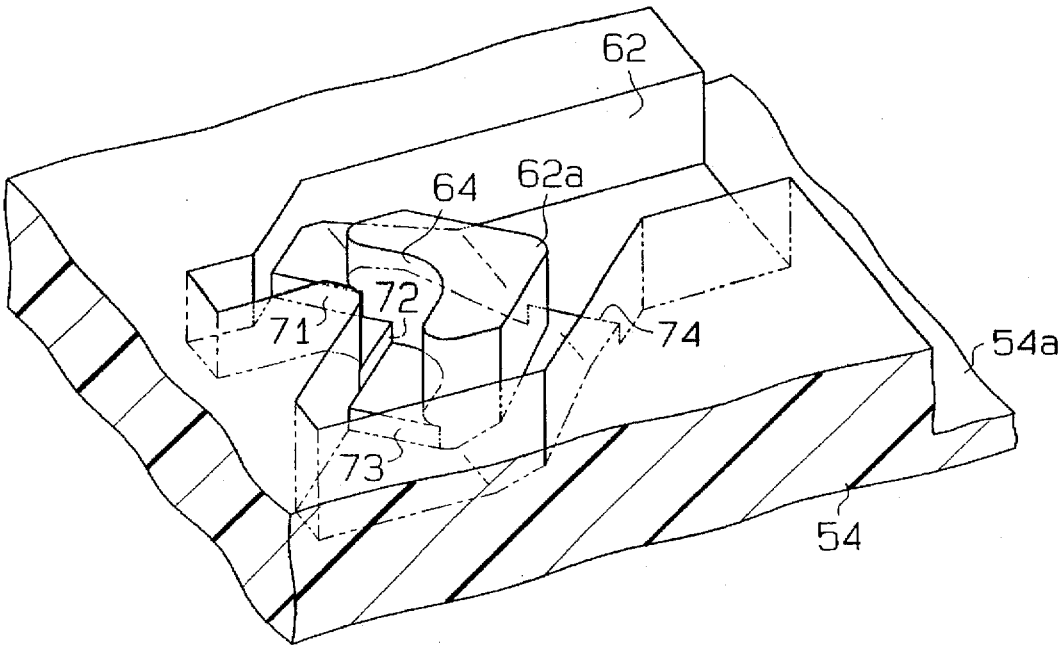
Fig.8 (Prior Art)
FIG. 8 is a perspective view illustrating the bottom of the cam groove shown in FIG. 7.

As shown in FIGS. 3 and 4, a cam groove 16, which is defined by a plurality of walls, is formed on a bottom surface 4*c* of the cover 4 as an inner wall of the switch body 2. The cam groove 16 has the same shape as that of the conventional cam groove 62 illustrated in FIGS. 7 and 8. Specifically, as shown in FIGS. 3 and 4, a protuberance 16*a*, which has a heart-shaped cross section, is provided to be surrounded by the cam groove 16. The recessed side portion of the protuberance 16*a* is used as a hooking recess 17, which may also be referred to as an engagement portion. In the cam groove 16, four steps 21, 22, 23 and 24 are formed to surround the protuberance 16*a*. The upper end or hook 15*a* of the lock pin 15 is inserted in the cam groove 16. The hook 15*a* is pressed against the bottom of the cam groove 16 by the pressing portion 14 of the first section 10A of the leaf spring 10. In FIG. 2, the cam groove 16 is illustrated by a two-dotted chain line to show the relative alignment of the lock pin 15 and the cam groove 16.

The assembling process and operation of the push lock switch according to the embodiment will now be described. The first step of the assembly is to mount the leaf spring 10 and the lock pin 15 to the knob holder 5. Then the knob holder 5 is accommodated in the chamber 200 of the casing 3, thereafter the casing 3 is covered by the cover 4. The movable contacts 11 formed on the tips of the comb-like section 10B of the leaf spring 10 are pressed against the first bottom surface 4*b* of the cover 4. The upper end or hook 15*a* of the lock pin 15 is pressed against the bottom of the cam groove 16 by the pressing portion 14 formed on the first section 10A of the leaf spring 10. In assembling the conventional push lock switch 51, the lock pin holder 60 needs to be mounted on the casing 52 after the lock pin 61 and lock pin spring 63 are mounted to the lock pin holder 60. In contrast with the conventional switch, according to this embodiment, only the process of mounting the leaf spring 10 to the knob holder 5 is required because the pressing portion 14 and the leaf spring 10 are united in one body. Therefore, the push lock switch according to the present invention is easier to assemble than the conventional push lock switch.

When the slider 6 is pressed in the direction B against the resilient force of the coil spring 7, the leaf spring 10 moves with the slider 6 so that the movable contacts 11 formed on the tips of the comb-like section 10B of the leaf spring 10 come into contact with the fixed contacts 9 on the terminals 8. This allows the terminals 8 to be electrically connected to one another via the leaf spring 10. In this case, the hook 15*a* of the lock pin 15 moves from the starting point to the hooking recess 17 along a path 25 indicated by a broken line in FIG. 3, while being guided by the steps 21 and 22. Then the hook 15*a* is engaged with the hooking recess 17. As a result, the knob holder 5, together with the knob 5*c*, is locked.

Another press of the knob 5*c* in the direction B causes the hook 15*a* to be disengaged from the hooking recess 17. Then the hook 15*a* returns to the starting point along a path 26 indicated by an alternate long and short dash line in FIG. 3, while being guided by the steps 23 and 24. The knob holder 5, together with the knob 5*c*, is projected in the direction opposite to the direction B by the coil spring 7. As a result, the movable contacts 11 are separated from the fixed contacts 9 so that the fixed contacts 9 are electrically disconnected from one another.

In the push lock switch according to this embodiment as described above, the lock pin 15 is rotatably supported in the hole 5e of the knob holder 5. The hook 15a of the lock pin 15 is inserted in the cam groove 16 formed on the cover 4 which constitutes a part of the switch body 2. Further, the conductive leaf spring 10 has the first section 10A including the pressing portion 14 to press the hook 15a against the bottom of the cam groove 16, and the second section 10B as a comb-like section including a plurality of the tips facing the fixed contacts 9. The tips of the comb-like section 10B are bent and serve as movable contacts (movable contacting means) 11, respectively. The leaf spring 10 is fixed to the knob holder 5 by inserting the implant part 12 in the recess 13.

As described above, the push lock switch according to the present present invention requires no lock pin spring 63, which is included in the conventional push lock switch 51, because the pressing portion 14 for pressing the lock pin 15 against the bottom of the cam groove 16 is united in one body with the leaf spring 10. Therefore, the number of parts of the push lock switch 1 of the present invention is smaller than the number of parts of the conventional push lock switch 51.

The cam groove 16 is formed on the bottom surface of the cover 4 which constitutes a part of the switch body 2. This enables the hook 15a to be inserted in the cam groove 16 only by inserting the lock pin 15 in the hole 5e of the knob holder 5 and engaging the cover 4 to the casing 3. In contrast with the conventional push lock switch 51, therefore, the step of mounting the lock pin holder 60, on which the lock pin 61 fitted, to the casing 52 can be omitted in the present push lock switch. This further facilitates the assembly of the push lock switch.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the following forms.

In the above-mentioned embodiment, the cam groove 16 is formed on the cover 4 and the lock pin 15 is retained rotatably in the hole 5e. In contrast with the embodiment, the cam groove 16 may be formed on the knob holder 5 and the hole 5e for rotatably retaining the lock pin 15 may be formed in the cover 4 or the casing 3. In this case, the pressing portion 14 formed on the leaf spring 10 should be adapted to press the lock pin 15 supported by the cover 4 or the casing 3 against the cam groove 16 of the knob holder 5.

In the above-mentioned embodiment, the casing 3 and the cover 4 to seal the opening at the top of the casing 3 are produced separately. The casing 3 and the cover 4 may be combined in one body. In the above-mentioned embodiment, the slider 6 is constituted by the knob holder 5 and the knob 5c attached to it. In contrast, the knob 5c and knob holder 5 may be formed by one part.

Therefore, the present examples and embodiments are to be considered as illustrative and not restrictive of the invention.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

We claim:

1. A push lock switch comprising:

a switch body comprising a wall, a plurality of terminals each having a fixed contact, a cam groove defined on said wall, and an engaging portion defined on said wall;

a slider, accommodated in said switch body, so as to be movable between a projecting position and a retracted position;

a lock pin having a first end inserted in said cam groove and a second end disposed in said slider, such that when said first end is engaged with said engaging portion, said slider is retained at said retracted position; and a conductive resilient member mounted on said slider and comprising a pressing portion for pressing the first end of said lock pin against a bottom of said cam groove and a movable contact for electrically contacting said fixed contacts of said terminals in accordance with movement of said slider to perform a switch function, said resilient member having a mounting portion for fixing the resilient member to the slider wherein the pressing portion extends in one direction from the mounting portion, and said movable contact extends in a second direction from the mounting portion, and wherein the first direction is substantially opposite to the second direction and said pressing portion, and said moveable contact being integrally formed.

2. The push lock switch as claimed in claim 1, wherein said switch body further comprises a casing having a chamber in which said slider is movably provided, and a cover to close said chamber.

3. The push lock switch as claimed in claim 2, wherein said slider further comprises, a knob, and a knob holder which is movably provided in the chamber defined in said casing and attached to said knob, and wherein said lock pin is rotatably supported on said knob holder.

4. The push lock switch as claimed in claim 3, wherein said cam groove is formed on a chamber side of an inner wall of said cover.

5. The push lock switch as claimed in claim 3, wherein said cover comprises an electrical insulation material, and wherein the plurality of terminals are provided on said cover.

6. The push lock switch as claimed in claim 1, wherein said resilient member comprises a leaf spring.

7. The push lock switch as claimed in claim 3, wherein a recess is disposed in said knob holder and wherein the mounting portion of said resilient member is disposed in said recess.

8. A push lock switch comprising:

a slider moveable between two positions;

a locking pin means for operationally engaging and disengaging a cam groove wherein said locking pin means is operationally mounted to said slider; and a conductive resilient member means connected to said slider for electrically contacting fixed contacts to perform a switching function when said slider moves between said positions and for pressing said locking pin means against said cam groove, said conductive resilient member having a pressing portion for performing said pressing, a movable contact for performing said electrical contacting, and a mounting portion for fixing the conductive resilient member to the slider, wherein the pressing portion extends in one direction from the mounting portion, and said movable contact extends in a second direction from the mounting portion and wherein the first direction is substantially opposite to the second direction.

9. A push lock switch comprising:

a switch body including an inner wall defining a chamber, a plurality of terminals each having a fixed contact, a cam groove defined in said wall, an engaging portion defined on said wall, and an opening to the chamber;

a slider accommodated in said chamber so as to be movable between a projecting position and a retracted position, the slider being adapted to be inserted into the opening during assembly of the switch in a direction toward the fixed contacts, said slider being spring biased toward the opening when the switch is assembled;

a lock pin having a first end fitted in said cam groove and selectively engaging the engaging portion and a second end connected to said slider such that, when said first end is engaged with said engaging portion, said slider is retained at said retracted position;

a movable contact joined to slider for electrically contacting said fixed contacts of said terminals in accordance with movement of said slider;

a pressing member for pressing the first end of the lock pin against the bottom of the groove; and wherein the groove is open toward the opening so that the first end of the lock pin can enter the groove from the direction of the opening when the slider is inserted into the opening during assembly.

10. The push lock switch according to claim 9, wherein the movable contact and the biasing member are integral elements of a conductive resilient member mounted on the slider.

* * * * *